US011603688B2

(12) United States Patent
Windmann

(10) Patent No.: US 11,603,688 B2
(45) Date of Patent: Mar. 14, 2023

(54) HINGE

(71) Applicant: Bohle AG, Haan (DE)

(72) Inventor: Frank Windmann, Langenfeld (DE)

(73) Assignee: Bohle AG, Haan (DE)

( * ) Notice: Subject to any disclaimer, the term of this patent is extended or adjusted under 35 U.S.C. 154(b) by 0 days.

(21) Appl. No.: 17/184,564

(22) Filed: Feb. 24, 2021

(65) Prior Publication Data

US 2021/0180378 A1 Jun. 17, 2021

Related U.S. Application Data

(63) Continuation of application No. 16/879,004, filed on May 20, 2020, now abandoned.

(30) Foreign Application Priority Data

May 21, 2019 (DE) ..... 102019113555.9

(51) Int. Cl.
*E05D 5/02* (2006.01)
*E05D 11/10* (2006.01)

(52) U.S. Cl.
CPC ..... *E05D 5/0246* (2013.01); *E05D 11/1007* (2013.01); *E05D 11/1064* (2013.01); *E05Y 2900/114* (2013.01); *E05Y 2900/132* (2013.01)

(58) Field of Classification Search
CPC ..... E05D 11/1064; E05D 11/1007; E05D 5/0246; E05D 2005/0253; E05D 2005/0261; E05D 2005/0269
See application file for complete search history.

(56) References Cited

U.S. PATENT DOCUMENTS 3,828,394 A * 8/1974 Horgan, Jr. ..... E05D 5/0246 16/241
5,079,798 A * 1/1992 Burke ..... E05D 11/1064 16/281
5,867,869 A * 2/1999 Garrett ..... E05D 5/16 16/334
6,481,055 B2 * 11/2002 Cheng ..... E05D 11/1064 16/334

(Continued)

*Primary Examiner* — Jeffrey O'Brien
(74) *Attorney, Agent, or Firm* — Patent Technologies, LLC; Robert D. Gunderman, Jr.

(57) ABSTRACT

The invention relates to a hinge for a swinging door, the hinge has at least one hinge axis element, a first hinge part and a second hinge part which are connected to one another in a hinge-like manner via the at least one hinge axis element, at least one latching arrangement, which comprises at least one latching means arranged at the second hinge part and comprising a latching body, and at least one latching recess arranged at the hinge axis element, wherein the latching means is configured such that the latching body engages in the latching recess in a latching position, and a clamping means for releasably fixing the hinge axis element to the first hinge part, wherein an angular position of the hinge axis element and the latching recess with respect to the first hinge part can be adjusted. The clamping means comprises at least one pair of clamping jaws for clamping the hinge axis element between these clamping jaws, wherein each of the clamping jaws comprises a clamping surface adapted to the contour of the hinge axis element.

13 Claims, 3 Drawing Sheets

(56) References Cited

U.S. PATENT DOCUMENTS

| | | | | |
|---|---|---|---|---|
| 6,526,627 | B2 * | 3/2003 | Chiang | E05D 11/1064 16/280 |
| 6,560,821 | B2 * | 5/2003 | Miller | E05D 5/0246 16/334 |
| 7,188,390 | B2 * | 3/2007 | Cheng | E05D 5/0246 16/241 |
| 8,720,005 | B2 * | 5/2014 | Cheng | E05F 3/10 16/54 |
| 9,140,043 | B2 * | 9/2015 | Chang | E05D 5/0246 |
| 10,480,230 | B2 * | 11/2019 | Brun | E05D 11/02 |
| 10,563,443 | B1 * | 2/2020 | Yang | E05F 3/20 |
| 2002/0066160 | A1 * | 6/2002 | Chiang | E05D 5/0246 16/277 |
| 2006/0162124 | A1 * | 7/2006 | Lin | E05D 5/0246 16/252 |
| 2009/0188082 | A1 * | 7/2009 | Huang | E05D 7/0018 16/382 |
| 2010/0275410 | A1 * | 11/2010 | Chang | E05F 1/1292 16/277 |
| 2012/0216370 | A1 * | 8/2012 | Chow | E05D 11/1064 16/386 |
| 2014/0068893 | A1 * | 3/2014 | Hung | E05F 3/20 16/52 |
| 2016/0076292 | A1 * | 3/2016 | Stuart | E05F 1/1215 16/297 |

* cited by examiner

HINGE

CROSS REFERENCE TO RELATED PATENT APPLICATIONS

This application is a continuation of U.S. patent application Ser. No. 16/879,004 filed May 20, 2020 entitled "Hinge", which claims priority to German Patent Application DE102019113555.9 filed on May 21, 2019 entitled "Gelenkband" (Hinge) by Frank Windmann, the entire disclosures of which are incorporated herein by reference in their entirety.

BACKGROUND OF THE INVENTION

1. Field of the Invention

This invention relates generally to a hinge, and more specifically a hinge for a swinging door.

2. Description of Related Art

Document DE 10 2011 088 192 A1 describes a hinge for a swinging door, with (i) at least one hinge axis element, (ii) a first hinge part and a second hinge part, which are connected to one another in a hinge-like manner via the at least one hinge axis element, (iii) at least one latching arrangement which comprises at least one latching means arranged at the second hinge part and including a latching body, and at least one latching recess arranged at the hinge axis element, wherein the latching means is configured in such a way that the latching body engages in the latching recess in a latching position and (iv) a clamping means for releasably fixing the hinge axis element at the first hinge part, wherein an angular position of the hinge axis element and the latching recess with respect to the first hinge part is adjustable. The clamping means comprises a locking screw held in/at the bearing element and designed as a grub screw with a conical tip as a clamping element, which presses on one side onto a conical end section of the hinge axis element in order to fix the selected angular position of the hinge axis element via a flank of this tip. Here, the force that occurs during tensioning/clamping only acts on as very small line-like area, so that there is a corresponding high pressure. Due to the one-sided loading, the hinge axis element can be tilted/canted, so that the force is distributed unevenly over the already small area, so that a quite high pressure can arise locally.

A corresponding high pressure can, however, lead to the formation of clamping marks on the hinge axis element. If the zero point setting is corrected, clamping marks from previous zero point settings can make the zero point setting more difficult, since the latching means "slides" with its clamping element into the old clamping mark and the zero point setting falls back to an old angular position value.

It is an object of the invention to provide a hinge in which such problems are at least significantly mitigated.

According to the invention, the object is achieved by the features of the independent claim. Preferred embodiments of the invention are specified in the dependent claims, which individually or in combination can represent an aspect of the invention.

BRIEF SUMMARY OF THE INVENTION

In accordance with the preset invention, there is provided a hinge for a swinging door comprising (i) at least one hinge axis element, (ii) a first hinge part and a second hinge part, which are connected to each other in a hinge-like manner via the at least one hinge axis element, (iii) at least one latching arrangement, which comprises at least one latching means arranged on the second hinge part and including a latching body and at least one latching recess arranged on the hinge axis element, wherein the latching means is configured in such a way that the latching body engages in the latching recess in a latching position and (iv) a clamping means for releasably fixing the hinge axis element to the first hinge part, wherein an angular position of the hinge axis element and the locking recess with respect to the first hinge part is adjustable.

The angular position of the two hinge parts when the latching body is latched into the latching recess, that is to say in a latching position, marks a zero point with respect to a swinging motion of the hinge parts with respect to one another or a corresponding door or a corresponding window. This zero point of the swinging motion can be shifted by rotating the two hinge parts with respect to each other when the clamping means is released. Here, the rotation takes place normally with the latching body latched into the latching recess. In this latching position, the angular position of the hinge axis element with respect to the second hinge part is well-defined. If the zero point is at the desired angular position of the first hinge part with respect to the second hinge part, the corresponding angular position of the hinge axis element with respect to the first hinge part is fixed via the clamping means, as a result of which the zero point is set.

In the hinge according to the invention, in particular for a swinging door, comprising (i) at least one hinge axis element, (ii) a first hinge part and a second hinge part, which are connected to one another in a hinge-like manner via the at least one hinge axis element, (iii) at least one latching arrangement, which comprises at least one latching means arranged at the second hinge part and including a latching body, and at least one latching recess arranged on the hinged axis element, Wherein the latching means is configured such that the latching body engages in the latching recess in a latching position, and (iv) a clamping means for releasably fixing the hinge axis element at the first hinge part, wherein an angular position of the hinge axis element and the latching recess with respect to the first hinge part can be adjusted, it is provided that the clamping means comprises at least one pair of clamping jaws for clamping the hinge axis element between these clamping jaws, wherein each of the clamping jaws has a clamping surface which is adapted to the contour of the hinge axis element. The forces that occur during tensioning/clamping act in opposite directions in pairs onto two extended surfaces, so that a relatively small contact pressure is generated in relation to the corresponding force. Due to the opposing forces occurring in pairs, tilting/canting of the at least one hinge axis element is avoided and there is a relatively uniform distribution of the forces over the respective surfaces, which prevents or at least significantly reduces the formation of clamping marks.

According to a preferred embodiment of the invention, the clamping surfaces of each pair of clamping jaws jointly overlap the circumference of the hinge axis element in a corresponding axis section by at least 33%, preferably by at least 50%. For 33% these are, for example, two opposing circumferential arcs of 60°, i.e. a total of 120° (=33% of 360°). For 50%, these are two opposing circumferential arcs of 90°, i.e. a total of 180°. The clamping marks created with these dimensions are usually hardly detectable.

According to a further preferred embodiment of the invention, the clamping means has a fixed clamping state with a well-defined clamping force of the clamping jaws with respect to the hinge axis element. The clamping means can optionally be brought in this state and also kept in this state. The clamping force can be selected such that a clamping mark in a hinge with such a clamping means indeed could lead to a reduced clamping force, but not to a "sliding" into the old clamping mark.

According to yet another preferred embodiment of the invention, the clamping means comprises two clamping means parts, each of which comprises one clamping jaw per pair of clamping jaws. In other words, n (with n=1, 2, . . . ) clamping jaw pairs are formed by use of only two clamping means parts. Here, the two clamping means must be movable with respect to each other.

According to a further preferred embodiment of the invention, it is provided that the clamping means comprises at least one means for setting a relative position of the clamping means parts with respect to one another, in particular in the form of a screw connection, in which the clamping jaws are in a clamping position that fixes the angular position of the hinge axis element clampingly. This is the abovementioned "specified clamping state".

Furthermore, it is advantageously provided that each of the two clamping means parts movable with respect to each other comprises a base and at least one arm at which the clamping jaw for the corresponding pair of clamping jaws is arranged spaced from the base. In contrast to the document DE 10 2011 088 192 A1 already stated at the beginning, the screw connection is not used directly for tensioning/clamping, but rather for setting the relative position of the clamping means parts with respect to one another by fixing the clamping means parts to each other.

It is advantageously provided that the means for setting a relative position of the clamping means parts with respect to each other respectively engages at the base of the clamping means parts. If this means is a screw connection, it is preferably a central screw connection, in particular by means of only one screw.

Furthermore, it is in particular provided that the clamping means parts comprise the base and two arms, which are arranged in a U-shape. Via this U-shape, the two clamping means parts which can be moved relative to one another can, for example, clampingly fix a single hinge axis element at its two ends.

According to yet another preferred embodiment of the invention, the contour of the at least one hinge axis element is circular cylindrical, wherein the clamping surfaces of the clamping jaws are adapted accordingly. For this purpose, each of the clamping jaws forms a kind of half-shell with respect to its respective clamping surface.

Furthermore, it is preferably provided that the latching means comprises a device for applying a force to the latching body. It is advantageously provided that the device for applying a force to the latching body comprises a spring means, in particular a compression spring. Such spring loading has proven itself in practice.

The foregoing has been provided by way of introduction, and is not intended to limit the scope of the invention as further described in this specification and the attached drawings and claims.

BRIEF DESCRIPTION OF THE DRAWINGS

The invention is explained by way of example with reference to the attached drawings based on preferred exemplary embodiments, wherein the features shown below both individually and in combination may represent an aspect of the invention. In the drawings.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification and the attached drawings and claims.

DESCRIPTION OF THE PREFERRED EMBODIMENTS

For a general understanding of the present invention, reference is made to the drawings. The present invention will be described by way of example, and not limitation. Modifications, improvements and additions to the invention described herein may be determined after reading this specification and viewing the accompanying drawings; such modifications, improvements, and additions being considered included in the spirit and broad scope of the present invention and its various embodiments described or envisioned herein.

Figure 1:
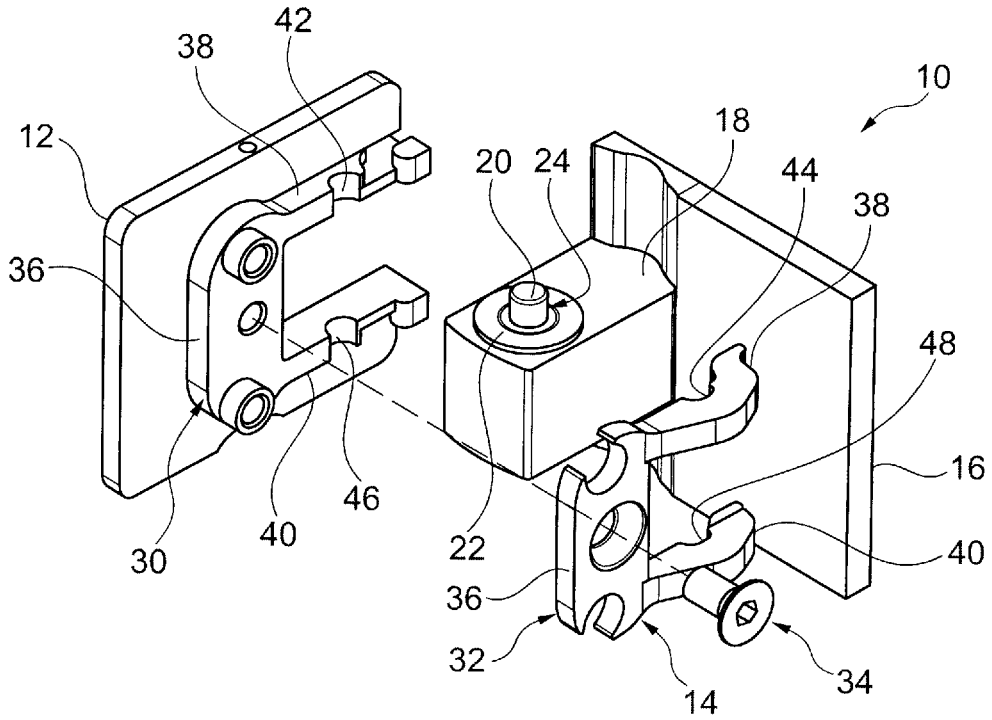
FIG. 1 shows assemblies of a hinge for a swinging door according to a preferred embodiment of the invention.
Figure 2:
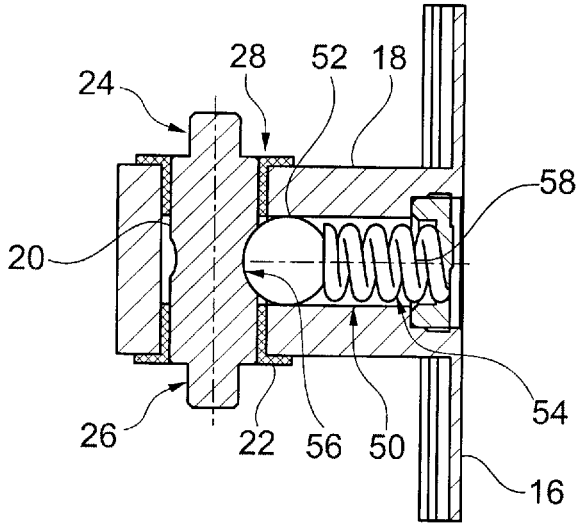
FIG. 2 shows a section through the assembly of the hinge in which a hinge axis element is mounted.

FIG. 1 shows the assemblies of a hinge 10, more precisely a hinge for a swinging door (not shown), in particular a glass swinging door. The first assembly comprises a first hinge part 12 and a clamping means 14. The second assembly comprises a second hinge part 16 and a bearing unit 18 fastened to the second hinge part 16, in which a pin-like hinge axis element 20 is rotatably mounted via a bearing bush 22. Here the end portions 24, 26 of the hinge axis element 20 protrude from the bearing unit 18 on opposite sides. Within the bearing unit 18 a latching arrangement 28 shown in FIG. 2 is provided, by means of which a zero point of the swinging movement of the swinging door is defined. The clamping means 14 comprises two clamping means parts 30, 32 that can be separated from one another, wherein the first clamping means part 30 is fastened to the first hinge part 12, while the second clamping means part 32 can be detachably fastened to the first clamping means part 30 via a screw connection 34. The screw connection 34 forms together with projection-recess arrangements a means for setting a relative position of the clamping means parts relative to one another.

Here in the example shown, the first hinge part 12 is a hinge part for a door leaf of the swinging door and the second hinge part 16 is a hinge part for attachment to a door frame, a wall or another fixed element. As an alternative, it is also possible and, in the case of corresponding configurations, also customary that the second hinge part 16 is the hinge part for the door leaf of the swinging door and the first hinge part 12 is a hinge part for fastening to a corresponding fixed element. The two hinge parts 12, 16 are connected to one another in a hinge-like manner within the assembled hinge 10 via the hinge axis element 20. As stated, via a latching position of the latching arrangement 28 a zero point of the swinging motion of the swinging door is obtained. In order to assign this zero point to an angular position of the swinging door or the first hinge part 12, the hinge axis element 20 can be releasably fixed to the first hinge part 12 via the clamping means 14 such that a desired angular position of the hinge axis element 20 with respect to the first hinge part 12 can be set.

Each of the clamping means parts 30, 32 movable with respect to each other has a U-shaped configuration with a base 36 and two arms 38, 40, wherein the screw connection 34 respectively takes place at the base 36. The clamping means 14 has a total of two pairs of clamping jaws 42, 44, 46, 48, of which one pair (comprising the clamping jaws 42, 44) can encompass the hinge axis element 20 circumferentially at its one end portion 24 and the other pair (comprising the clamping jaws 46, 48) can encompass the hinge axis element 20 circumferentially at its other end portion 26 and thereby clamp it releasably. Each of the clamping means parts 30, 32 comprises in a central portion of its arms 38, 40 respectively one clamping jaw 46, 48 per pair of clamping jaws 42, 44, FIG. 2 shows a section through the second assembly of the hinge 10, wherein the section is taken through the bearing unit 18 at the level of the hinge axis element 20. In the bearing unit 18 there is disposed—in addition to the hinge axis element 20 and the bearing bush 22 for mounting the hinge axis element 20—also the latching arrangement 28, which comprises a latching means 50 with a latching body 52 and a device 54 for applying a force to the latching body 52 as well as a latching recess 56 formed in the hinge axis element 20. The device 54 for applying a force to the latching body 52 is essentially a compression spring 58 which presses the latching both 52 in the direction of an axis portion of the hinge axis element 20 in which the latching recess 56 is formed. In other words, the latching means 50 is arranged such that the latching body 52 engages in the latching recess 56 in a latching position.

The angular position of the two hinge parts 12, 16 when the latching body 52 is latched into the latching recess 56, that is to say in a latching position, marks a zero point with respect to swinging motion of the hinge parts 12, 16 with respect to one another or a corresponding door or a corresponding window. This zero point of the swinging motion can be shifted by rotating the two hinge parts 12, 16 with respect to one another when the clamping means 14 is released. The rotation generally takes place with the latching body 52 latched into the latching recess 56. In this latching position, the angular position of the hinge axis element 20 with respect to the second hinge part 12 is well-defined. If the zero point is at the desired angular position of the first hinge part 12 relative to the second hinge part 16, the corresponding angular position of the hinge axis element 20 with respect to the first hinge part 12 is fixed via the clamping means 14, whereby the zero point is set. For this purpose, the screw of the screw connection 34 is simply tightened at a corresponding angular position.

Figure 3:
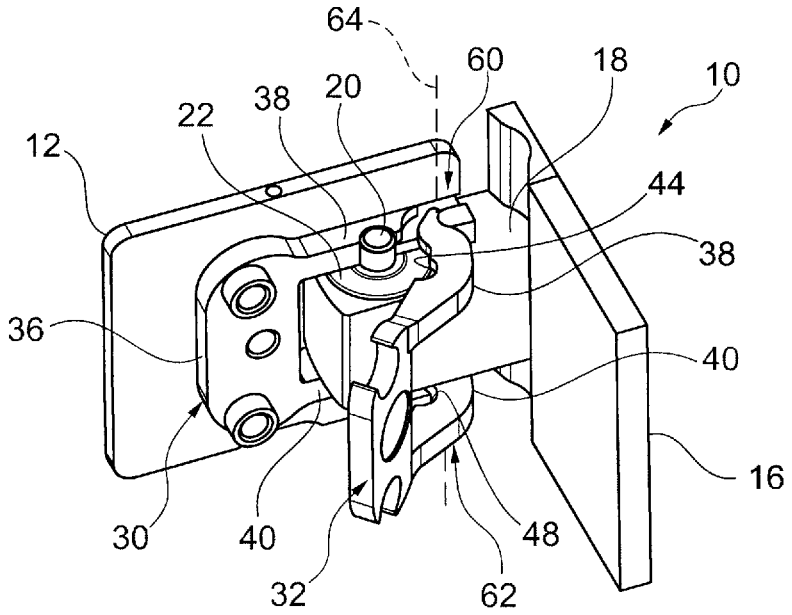
FIG. 3 shows a 3D view of the hinge with the clamping means released.

FIG. 3 shows a view of the hinge 10 with the clamping means 14 released. In this illustration it can be seen that the free ends of the mutually associated arms 38, 40 of the two clamping means parts 30, 32 form joints 60, 62 with respect to a common axis of rotation 64. The clamping means parts 30, 32 can be pivoted relative to one another with respect to this axis 64. The hinge axis element 20 is not fixed with respect to the first hinge part 12.

Figure 4:
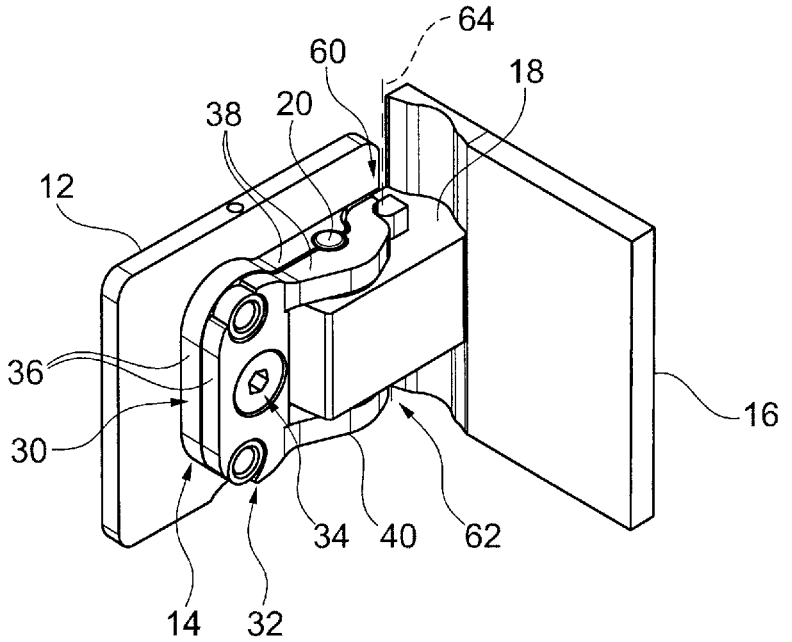
FIG. 4 shows a 3D view of the hinge with the hinge axis element fixed per clamping means.

FIG. 4 shows a view of the hinge 10 with fixed clumping means 14 and with the hinge axis element 20 fixed per clamping means 14. Here, the joints 60, 62 are disposed on one side of the clamping jaws 42, 44, 46, 48 and the screw connection 34 is disposed on the other side of the clamping jaws 42, 44, 46, 48. This results in a large lever and thus a high clamping force.

Figure 5:
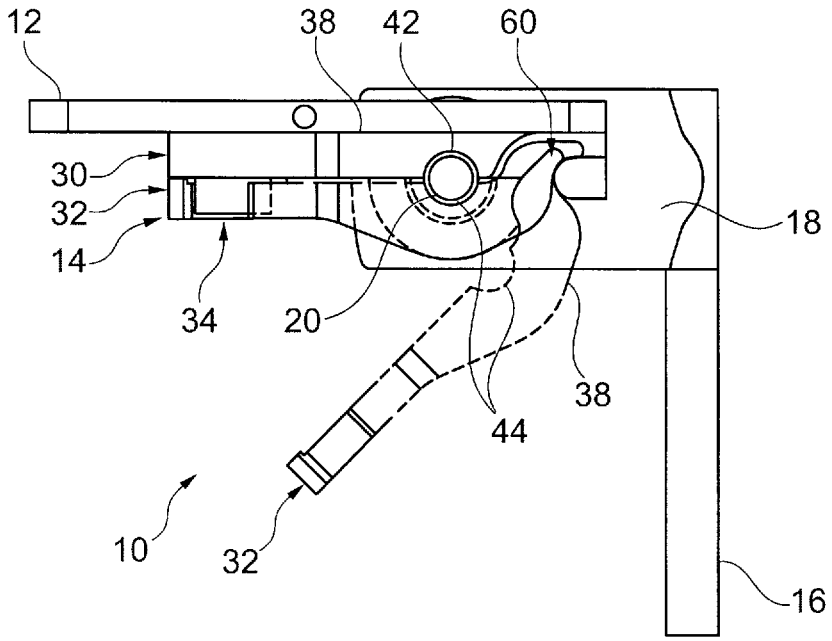
FIG. 5 shows a comparison of the states of the hinge shown in FIGS. 3 and 4 in a top view.

Finally, FIG. 5 shows a comparison of the states of the hinge 10 shown in FIGS. 3 and 4 in a top view. It can be clearly seen that the clamping surfaces of the clamping jaws 40, 42; 46, 48 of each pair overlap the circumference of the hinge axis element 20 in the corresponding axis section 24, 26 together almost completely, that is to say over 90%.

REFERENCE SYMBOLS

10 hinge
12 first hinge part
14 clamping means
16 second hinge part
18 bearing unit
20 hinge axis element
22 bearing bush
24, 26 end portion (hinge axis element)
28 latching arrangement
30 first clamping means part
32 second clamping means part
34 screw connection
36 base
38, 40 arm
42, 44 clamping jaw (first pair)
46, 48 clamping jaw (second pair)
50 latching means
52 latching body
54 force application device
56 latching recess
58 compression spring
60, 62 joint
64 axis of rotation While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification and the attached drawings and claims.

What is claimed is:

1. A hinge (10) for a swinging door, the hinge (10) comprising:

a hinge axis element (20) comprising a circumference and a latching recess (56);

a first hinge part (12) and a second hinge part (16);

the first hinge part (12) comprising a first clamping part (30) having a base (36) with a first arm (38) and a second arm (40) where the first arm (38) has a clamping jaw and the second arm (40) has a clamping jaw;

a bearing unit (18) attached to the second hinge part (16) and pivotally attached to the hinge axis element (20);

a latching body (52) within the bearing unit (18) wherein the latching body (52) is held against the hinge axis element (20) by a force application device (54) such that as the hinge axis element (20) rotates in the bearing unit (18) the latching body (52) will encounter the latching recess (56) of the hinge axis element and engage with the latching recess (56) in a latching position;

a second clamping part (32) having a base (36) with a first arm (38) and a second arm (40);

wherein the first arm (38) of the second clamping part (32) has a clamping jaw configured to circumferentially retain an upper end portion of the hinge axis element (20) through engagement with the clamping jaw of the first arm of the first hinge part (12); and wherein the second arm (40) of the second clamping part (32) has a clamping jaw configured to circumferentially retain a lower end portion of the hinge axis element through engagement with the clamping jaw of the second arm of the first hinge part;

the latching position of the hinge being related to the position of the latching recess (56) with respect to the latching body (52) as determined by the circumferential placement of the clamping jaws about the hinge axis element (20);

wherein the first clamping part (30) adjustably engages with the second clamping part (32) along a common axis of rotation (64) parallel to the hinge axis element (20);

wherein the first clamping part (30) and the second clamping part (32) are adjustably fastened by a single screw connection (34) such that adjustment of the latching position of the hinge is accomplished by loosening the single screw connection (34), rotating the first clamping part (30) and the second clamping part (32) about the hinge axis element (20) until a desired latching position is achieved, and then tightening the single screw connection (34).

2. The hinge according to claim 1, wherein the first clamping part (30) and the second clamping part (32) are separable from each other.

3. The hinge according to claim 1, wherein the first clamping part (30) and the second clamping part (32) are aligned with a male to female alignment structure.

4. The hinge according to claim 1, further comprising: a screw connection (34) between the first damping part (30) and the second clamping part (32).

5. The hinge according to claim 1, wherein the screw connection (34) serves to adjust the angular position of the first clamping part (30) and the second clamping part (32) in relation to the binge axis element (20).

6. The hinge according to claim 1, wherein at each of the clamping parts the base (36) and the first arm (38) and the second arm (40) are arranged in a U-shape.

7. The hinge according to claim 1, wherein the hinge axis element (20) is cylindrical.

8. The hinge according to claim 1, wherein the latching body (52) is spherical.

9. The hinge according to claim 1, wherein the force application device (54) is a spring.

10. The hinge according to claim 1, wherein a clamping surface of the clamping jaw of the first arm (38) of the first hinge part (12) spans 33%-50% of the circumference of the hinge axis element (20).

11. The hinge according to claim 1, wherein a clamping surface of the clamping jaw of the second arm (40) of the first hinge part (12) spans 33%-50% of the circumference f the hinge axis element (20).

12. The hinge according to claim 1, wherein a clamping surface of the clamping jaw of the first arm (38) of the second clamping part (32) spans 33%-50% of the circumference of the hinge axis element (20).

13. The hinge according to claim 1, wherein a clamping surface of the clamping jaw of the second arm (40) of the second clamping part (32) spans 33%-50% of the circumference of the hinge axis element (20).

* * * * *